United States Patent [19]

Wood et al.

[11] Patent Number: 4,867,363

[45] Date of Patent: Sep. 19, 1989

[54] WEB LOADING AND FEEDING SYSTEM

[75] Inventors: Kenneth O. Wood, Ellington; John E. Ladue, Tolland; David J. Logan, Glastonbury, all of Conn.

[73] Assignee: Gerber Scientific Products, Inc., Manchester, Conn.

[21] Appl. No.: 191,847

[22] Filed: May 4, 1988

Related U.S. Application Data

[63] Continuation-in-part of Ser. No. 73,404, Jul. 13, 1987, abandoned, which is a continuation of Ser. No. 809,053, Dec. 13, 1985, abandoned.

[51] Int. Cl.[4] ..... B41J 11/28; B65H 20/20

[52] U.S. Cl. ..... 226/76; 226/87; 400/616.3

[58] Field of Search ..... 226/52, 76, 75, 87; 400/616–616.3; 281/2, 5; 282/11.5 A

[56] References Cited

U.S. PATENT DOCUMENTS

| | | | |
|---|---|---|---|
| 911,236 | 2/1909 | Groebli . | |
| 1,065,133 | 6/1913 | Ivatts | 352/241 |
| 1,144,414 | 6/1915 | Holmes | 226/87 |
| 1,158,767 | 11/1915 | Amrhein . | |
| 1,299,469 | 4/1919 | Holmes | 226/87 |
| 1,368,994 | 2/1921 | Johnson | 282/21 D |
| 1,944,387 | 1/1934 | Wright . | |
| 2,351,075 | 6/1944 | Schultz . | |
| 2,352,757 | 7/1944 | Barker | 282/11.5 A |
| 2,500,196 | 3/1950 | Metzner | 226/87 |
| 3,058,638 | 10/1962 | Christoff et al. . | |
| 3,146,283 | 8/1964 | da Valle . | |
| 3,360,210 | 12/1967 | Frisbie . | |
| 3,640,481 | 2/1972 | Pugh | 242/56.8 |
| 3,690,011 | 9/1972 | Burchell . | |
| 3,706,249 | 12/1972 | Bruckner . | |
| 3,809,410 | 5/1974 | Johnson | 281/5 |
| 3,857,525 | 12/1974 | Gerber et al. | 242/57.1 |
| 3,987,884 | 10/1976 | Buxton . | |
| 3,993,814 | 11/1976 | Cavender . | |
| 4,026,405 | 5/1977 | de Poncins . | |
| 4,307,897 | 12/1981 | Sarkans et al. | 282/21 D X |
| 4,467,525 | 8/1984 | Logan et al. | 33/18 B |

FOREIGN PATENT DOCUMENTS

| | | | |
|---|---|---|---|
| 841909 | 9/1984 | South Africa . | |
| 565090 | 10/1944 | United Kingdom | 226/76 |
| 632590 | 11/1949 | United Kingdom | 226/76 |

*Primary Examiner*—John M. Jillions

*Attorney, Agent, or Firm*—McCormick, Paulding & Huber

[57] ABSTRACT

A web loading and feeding system comprises an elongated web and a web loading and feeding machine. The web is fed longitudinally of itself through the machine by a pair of drive sprockets having pins which cooperate with holes in side edge portion of the web. The hole arrangement in the web and the pin arrangement on the sprockets readily enable a machine operator to visually determine how to properly load the web onto the sprockets.

10 Claims, 4 Drawing Sheets

WEB LOADING AND FEEDING SYSTEM

CROSS-REFERENCE TO RELATED APPLICATIONS

This application is a continuation-in-part of application Ser. No. 07/073,404 filed July 13, 1987, now abandoned which in turn is a continuation of application Serial No. 06/809,053 filed Dec. 13, 1985 now abandoned.

BACKGROUND OF THE INVENTION

The invention relates generally to a web loading and feeding system including a web and a web handling machine such as a plotter, recorder or sign maker. The web is fed longitudinally of itself through the machine by a pair of sprockets cooperating with holes in two longitudinal side edge portions of the web. The invention deals more particularly with the web for the machine and the pair of sprockets within the machine, the web having a hole arrangement and the sprockets having a pin arrangement which together indicate the proper loading orientation of the web on the sprockets.

Sprockets in machines of the type with which this invention is concerned are typically mounted for rotation about a common drive axis and have pins or teeth-like members on their peripheries which engage rows of holes in two side edge portions of a web being fed. To ensure error free operation, it is important that the web is properly loaded on the machine so that the sprocket pins engage the correct web holes. This means that two corresponding pins of the two sprockets located in a common plane passing through the sprocket drive axis engage two corresponding holes in the web located on a common line extending perpendicularly to the longitudinal side edges of the web. When the web is very wide, it is difficult to visually determine which sprocket pins correspond with one another and which holes on the opposite sides of the web correspond with one another and, as a result, web loading errors may occur. The resultant errors in pattern cutting or plotting may be small depending on the degree of misalignment, so the error may go undetected for a considerable period of time, wasting much web material and human labor.

Patent application Ser. No. 529,960 by Logan and corresponding South African Patent No. 84/1909 issued on 9-26-84 disclose a web loading and feeding system which provides means to identify the proper loading orientation of a web on a pair of drive sprockets. As disclosed there in reference to one embodiment of that invention, each of the sprockets has a series of radially, outwardly extending driving pins uniformly spaced around the sprocket's periphery and an extra keying pin situated between two of the driving pins. The keying pins of the two sprockets are located in a common plane passing through the axis of the sprockets. An associated web has a longitudinal row of uniformly spaced driving holes in each side edge portion. The spacing of the driving holes corresponds to the spacing of the driving pins. In addition to the driving holes, the web has a longitudinal row of keying holes in each side edge portion, the keying holes in one side edge portion laterally align with the keying holes in the other side edge portion. Also, the spacing of the keying holes in each row corresponds to the size of the sprocket and the location of the keying pins so that the web may be correctly loaded on the sprockets by placing a pair of laterally aligned keying holes over the keying pins of the sprockets.

In the 529,960 embodiment described above, the keying pins and the driving pins on both sprockets have the same shape, and the keying pin on each sprocket is somewhat spaced from the closest driving pin. Also, in that embodiment, the keying holes in each side edge portion have the same shape as the driving holes and each keying hole is spaced from the nearest driving hole by a distance corresponding to that between the keying pin and the closest driving pin.

Such a web loading and feeding system has proven effective in minimizing web loading errors of the foregoing type; however, it is desirable to further improve the ease at which and the assurance with which the proper web loading orientation may be visually determined.

Accordingly, a general aim of the invention is to provide a web loading and feeding system comprising a web having a hole arrangement and sprockets having a pin arrangement which web and sprockets readily enable a machine operator to visually determine which holes of the web to place over which pins on the sprockets to properly load the web.

A more specific aim of the invention is to provide a web of the foregoing type having a hole arrangement which wastes little of the web material.

Other aims and advantages of the invention will become apparent from the following detailed description of the preferred embodiments and from the accompanying drawings.

SUMMARY OF THE INVENTION

The invention resides in an elongated web for a web handling machine and a pair of web drive sprockets within the machine, which web and sprockets readily enable an operator to visually determine how to properly load the web onto the sprockets and make it virtually impossible for the machine to feed an improperly loaded web without the error being obvious. According to one feature of the invention, each of the sprockets has a series of radially outwardly extending driving pins located in a common plane and uniformly spaced from one another around most of its periphery; the driving pins of one sprocket laterally align with the driving pins of the other sprocket. Each sprocket also includes two keying pins located along a keying portion of the periphery of the sprocket, which keying portion is located between two driving pins and has a length greater than two times and less than three times the length of the uniform spacing between two adjacent driving pins. The two keying pins are located on opposite sides of the center of the keying portion and are spaced closer than said uniform spacing to one another, and the keying pins of one sprocket laterally align with the keying pins of the other sprocket.

Also, the web includes driving holes located in each side edge portion, which driving holes are longitudinally aligned with one another and grouped into row segments separated by keying zones. Each keying zone has a length greater than twice and less than three times the length of the uniform spacing between the driving holes. The two keying holes of each keying zone are located on opposite sides of the longitudinal center of the keying zone and are spaced from one another by a spacing less than that of said uniform spacing. Therefore, each keying zone represents a readily visibly discernible interruption in the regular spacing of the driving holes insofar as each keying zone has a length not an integral multiple of the uniform spacing of the driving holes and contains two keying holes more closely spaced to one another then are the driving holes to one another. Each driving hole on one side of the web is laterally aligned with a driving hole on the other side of the web, and each keying zone includes two keying holes which, in turn, receive keying pins of each sprocket. Within each row segment the driving holes are uniformly spaced from one another. The size and/or shape of the keying holes may also be different than the size and/or shape of the driving holes so as to make them still more easily identifiable for placement on corresponding keying pins of the sprockets to assure proper web loading.

DETAILED DESCRIPTION OF THE PREFERRED EMBODIMENT

Figure 1:
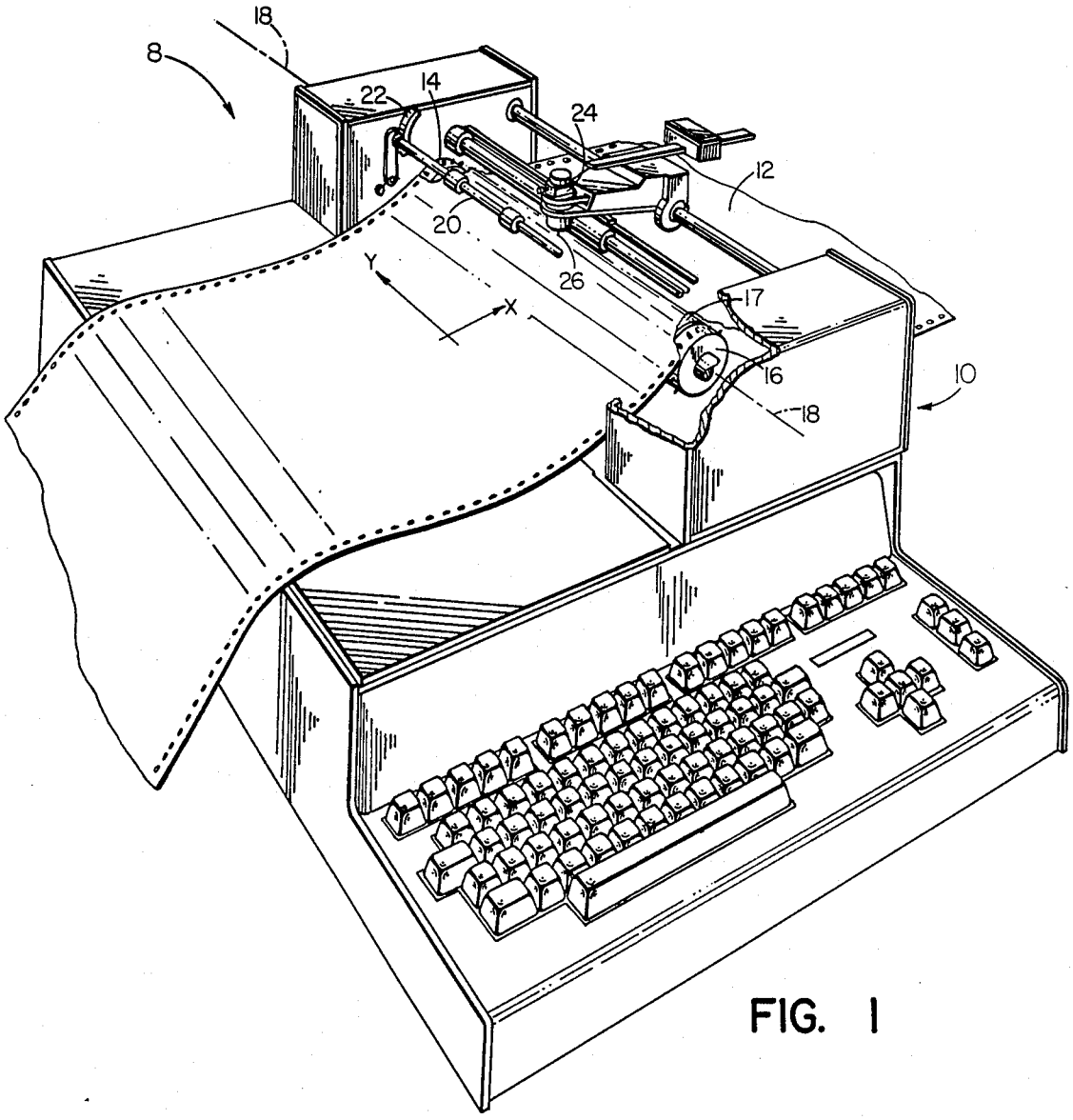
FIG. 1 is a perspective view of a sign making machine and a web which embody the present invention with various portions of the machine and the web being broken away to reveal additional features.

Referring to FIG. 1, the invention is there illustrated as embodied within a web loading and feeding system 8 which includes a sign making machine 10 and an associated web 12. The machine 10 is of the type shown and described in more detail in U.S. Pat. No. 4,467,525 to Logan and Sullivan issued Aug. 28, 1984, assigned to the assignee of the present invention and hereby adopted by reference as part of the present disclosure. The web has holes (discussed in more detail below) in its side edge portions and is moved longitudinally of itself, in the illustrated X-coordinate direction, by a pair of drive sprockets 14,16 which are supported for driven rotation in unison about a common drive axis 18 and have pins or teeth which engage the holes. A platen or roller 17 located between the two sprockets 14 and 16, and similar to that of a typewriter, supports a transverse portion of the web 12 aligned with the sprockets 14,16.

The machine 10 further includes two web holddown bails, one for each sprocket 14 and 16, carried by a transverse rod 20 which bails normally hold the web in engagement with the sprockets. In FIG. 1 only one such holddown bail 22 associated with the sprocket 14 is shown and this bail along with the supporting rod 20 is shown in its raised position to give a clearer view of the associated sprocket.

The machine 10 also includes a tool head 24 suitably supported and driven in the illustrated Y-coordinate direction relative to the web 12.

In a normal sign making mode of operation, the tool head 24 is equipped with a knife-type cutter 26 and the web 12 is an elongated piece of sign making stock. The web 12 and the tool 26 are moved relative to one another simultaneously in the X- and Y-coordinate directions through the operation of the machine 10 to cut alphanumeric characters or other indicia from the sign making stock. Later, the cut characters or indicia are transferred to another carrier to form a finished sign.

The machine 10 also may be operated in a plotting mode during which a pencil or other plotting instrument is placed in the head 24 in place of the cutting tool 26 and a webbed sheet of paper or the like is fed through the machine. One purpose of the plotting mode is to allow a proposed sign to be plotted first on paper to check the accuracy of the information entered into the machine before the more expensive sign making stock is cut.

Because the machine 10 is typically operated in both the plotting and cutting modes and many different sign patterns are plotted and cut during the course of a day and there is a wide variety of sign making web materials from which the patterns may be cut, an operator must load a web onto the machine many times each day. When the web is properly loaded, lines extending laterally of the web, that is perpendicular to is side edges, are parallel to the sprocket axis 18 as the web is fed longitudinally of itself through the machine by rotation of the sprockets. Typically, the web 12 may be wide, for example, fifteen inches, and the holes formed in each side edge portion of the web may be closely spaced to one another, for example, on one-half inch centers or less and if the web is loaded onto the sprockets even one hole out of alignment, errors in cutting or plotting may occur.

Figure 2:
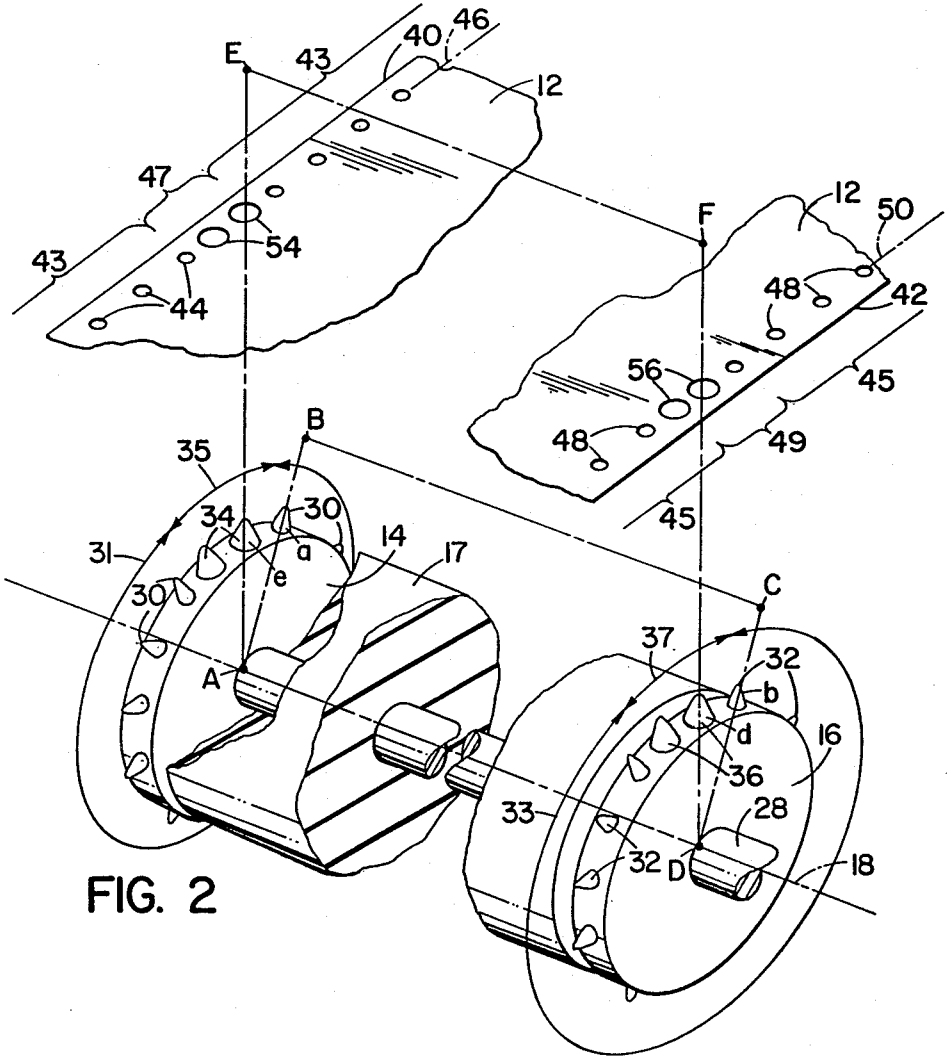
FIG. 2 is a fragmentary perspective view showing the relationship between the sprockets and the web during the loading of the web onto the machine of FIG. 1.

Referring to FIG. 2, the two sprockets 14 and 16 of the web loading and feeding system 8 are both fixed to a common drive shaft 28 for rotation about a common axis 18. The sprocket 14 has a series of radially outwardly extending driving pins 30, 30 located in a common plane perpendicular to the axis 18 and uniformly spaced from one another around a large portion of the perimeter of the sprocket 14 as indicated by an arc 31. In a manner identical to the spacing of the driving pins 30, 30 of the sprocket 14, the sprocket 16 has a series of radially outwardly extending driving pins 32, 32 located in a common plane perpendicular to the axis 18 and uniformly spaced from one another around a large portion of the perimeter of the sprocket 16 as indicated by an arc 33. In the illustrated embodiments the number of pins 30, 30 on the sprocket 14 and the number of pins 32, 32 on the sprocket 16 is twelve; however, this number may vary from device to device. Furthermore, the sprockets 14 and 16 are so relatively arranged that each pin 30 is at least substantially aligned with and corresponds to a pin 32 so that each corresponding pair of pins are located in, or at least substantially in, a common plane passing through the axis 18. For example, in FIG. 2 one such common plane is shown at ABCD and contains a pair of corresponding pins 30 and 32 indicated as a and b.

In keeping with the invention, the sprocket 14 includes two enlarged keying pins 34, 34 and the sprocket 16 includes two enlarged keying pins 36,36. The keying pins 34,34 are located on a portion of the periphery of the sprocket 14 defined by an arc 35 which portion compliments the much larger portion defined by the arc 31 and are also located in the same plane perpendicular to the sprocket axis 18 as the driving pins 30, 30. Likewise the keying pins 36,36 are located on a portion of the periphery of the sprocket 16 defined by an arc 37 which portion compliments the much larger portion defined by the arc 33 and are also located in the same plane perpendicular to the sprocket axis 18 as the driving pins 32,32. Each keying pin 34 aligns with and corresponds to a keying pin 36 so that each corresponding pair of such keying pins is located in a common plane passing through the axis 18, such as a plane at AEFD containing the keying pins indicated as d and e.

The pair of keying pins 34, 34 stands out from the driving pins 30, 30 because the keying pins of the pair are larger and spaced closer to each other than are the driving pins 30, 30, and likewise the pair of keying pins 36,36 stands out from the driving pins 32,32 because the keying pins 36,36 are larger and spaced closer to each other than are the driving pins 32,32. Consequently, the keying pins 34,34 and 36,36 visually identify laterally aligned portions of the sprockets 14 and 16 to aid in loading the web correctly.

Figure 6:
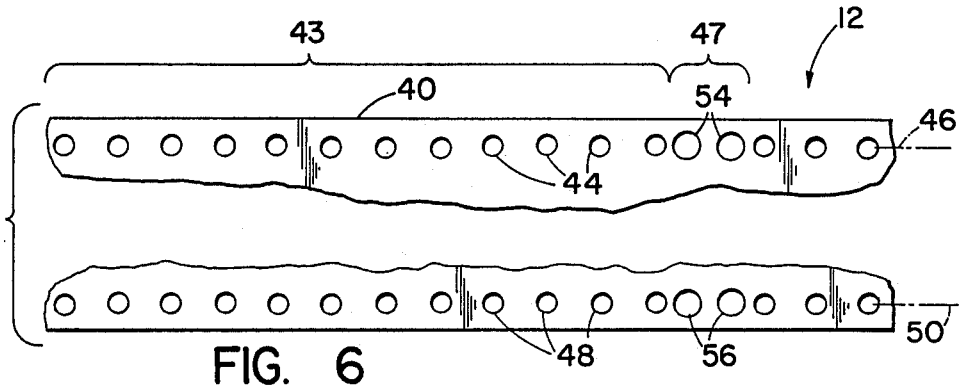
FIG. 6 is an enlarged scale, fragmentary plan view of the web of FIG. 4.
Figure 3:
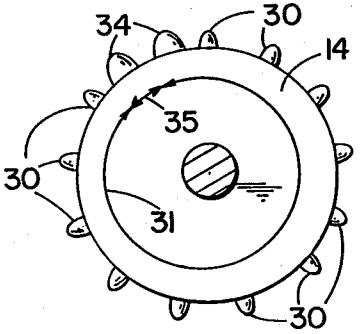
FIG. 3 is a side view of one of the sprockets of FIG. 1.
Figure 4:
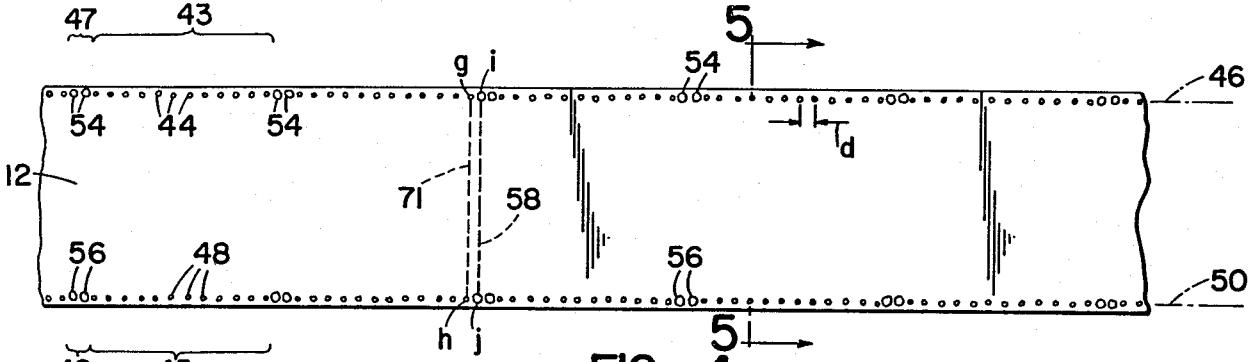
FIG. 4 is a reduced scale plan view of a portion of the web of FIG. 1.

The web 12, as shown in FIGS. 2, 4 and 6, comprises an elongated piece of sheet-like material having parallel side edges 40 and 42. Sets or row segments 43,43 of the driving holes 44,44 are located in a side edge portion of the web 12 adjacent the side edge 40. All the holes of all the row segments 43,43 are located on a first line 46 spaced slightly inwardly from the edge 40 and the holes within each row segment are uniformly spaced from one another by a spacing corresponding to the spacing between the pins 30, 30 of the sprocket 14. Likewise, sets or row segments 45,45 of driving holes 48,48 are located in an edge portion adjacent the edge 42. All the holes of all the row segments 45,45 are located on a line 50 spaced slightly inwardly from the edge 42 and the holes within each row segment are uniformly spaced from one another by a spacing corresponding to the spacing between the driving pins 32,32 and equal to that of the spacing of the driving holes 44,44.

Furthermore, as shown in FIG. 4 each driving hole 44 laterally aligns with and corresponds to a driving hole 48, for example, the driving holes identified as g and h lie on a common line 71 extending perpendicular to the web side edges and perpendicular to the lines 46 and 50 containing the rows of holes.

The web 12 also includes enlarged keying holes 54,54 on the line 46 within keying zones 47,47 which keying zones and keying holes separate the row segments 43,43 from one another. Likewise the web 12 includes enlarged keying holes 56,56 on the line 50 within keying zones 49,49 which keying zones and keying holes separate the row segments 45,45 from one another. All the holes in the web 12 are shown as being round, but this need not always be the case. As shown in FIGS. 2, 4 and 6, the keying holes 54,54 within each keying zone 47 are spaced closer to each other than are two adjacent drive holes 44,44 within each row segment 43. By way of example, the distance between the center of the driving hole 44 adjacent one side of the keying zone 47 and the center of the driving hole 44 adjacent the other side of the keying zone 47 is twice the distance between the centers of any two adjacent driving holes 44,44 within a row segment. Furthermore, in this example the keying holes 54,54 within each keying zone straddle a point on the web equidistant between the two adjacent, surrounding driving holes 44,44; the distance from each of these driving holes 44 to the equidistant point equals the distance between two adjacent drive holes within each row segment 43. Similarly the keying holes 56,56 straddle a point equidistant between the two adjacent, surrounding drive holes 48,48; the distance from each of these driving holes 48 to the equidistant point equals the distance between two adjacent driving holes within each row segment 45.

Each keying hole 54 laterally aligns with and corresponds to a keying hole 56, for example, the keying holes identified as i and j in FIG. 4 lie on a common line 58 extending perpendicular to the side edges 40, 42 of the web and to the lines 46 and 50. Therefore, as evident from FIGS. 2 and 4, the keying holes 54,54 within one keying zone 47 and the corresponding keying holes 56,56, by their large size and close spacing, identify aligned regions of the side edge portions of the web to be placed over the keying pins 34,34 and 36,36 to ensure proper loading of the web 12 on the sprockets 14 and 16.

To load the web 12, the sprockets are turned to move the keying pins 34,34 and 36,36 upwardly to a web loading position and the web is then moved downwardly onto the sprockets bringing the keying holes 54,54 and 56,56 onto the keying pins 34,34 and 36,36 and bringing the drive holes 44,44 and 48,48 which surround the keying holes at least partially onto the corresponding driving pins 30,30 and 32,32. The engagement of the driving holes by the driving pins may be only partial because of the curvature of the sprockets 14 and 16. Accordingly, proper movement of the web from that point on is assured.

The holes 44,44 and 54,54 longitudinally align with one another as near the side edge 40 as practical to maximize the usable area of the web 12 but to avoid tearing when subjected to forces of engaging pins. For the same reasons and with the same constraints, the holes 48,48 and 56,56 longitudinally align with one another as near the side edge 42 as practical. Also, the longitudinal alignment of the holes 44,44 with the holes 54,54 and that of the holes 48,48 with the holes 56,56 allow the use of relatively simple sprockets 14 and 16. If the holes in one side edge portion of the web were not all longitudinally aligned with one another, then a second sprocket or a lateral extension of the respective sprocket 14 or 16 may be required to mount pins capable of reaching and engaging all the holes.

In the illustrated embodiment, pairs of keying holes 54,54 and pairs of keying holes 56,56 are spaced uniformly from one another along the length of the web by a distance S equal to $(N+1)d$, where d is the spacing between two driving holes 44,44 within a row segment and is the spacing between two adjacent driving holes 48,48 within a row segment, and where N is the number of driving pins 30,30 on the sprocket 14 and the number of driving pins 32,32 on the sprocket 16. In the illustrated case the number of pins 30,30 is twelve as is the number of pins 32,32 and therefore S equals 13d. Each time the sprockets 14 and 16 undergo one revolution the keying pins 34,34 engage two keying holes 54,54 and the keying pins 36,36 engage two corresponding keying holes 56,56, and the 12 driving pins 30,30 engage the 12 driving holes 44,44 within one row segment 43 and the 12 driving pins 32,32 engage the 12 driving holes 48,48 within one row segment 45.

Figure 5:
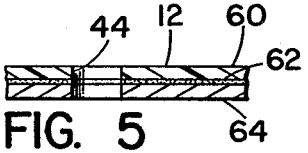
FIG. 5 is an enlarged scale, fragmentary sectional view through the web taken on the line 5—5 of FIG. 4.

As indicated previously, the web 12 may take various different forms and, in FIG. 5, the web 12 is shown to comprise a piece of sign making stock having an upper layer 60 and a release layer 64. The upper layer is made of a thermoplastic material such as vinyl on the order of three to five mils thick with an adhesive backing or coating 62. This upper layer is supported on the release layer 64 and releasably held by the adhesive backing 62. The release layer may consist of a ninety-pound paper coated or impregnated with silicone to give it its release property.

If a type of web utilized with the machine 10 exhibits significant variations in width due to variations in temperature and humidity or manufacture tolerance, then a spline shaft and a sprocket slidably mounted thereon may be substituted for the sprocket 14 and the shaft 28 to accommodate such variations.

Figure 7:
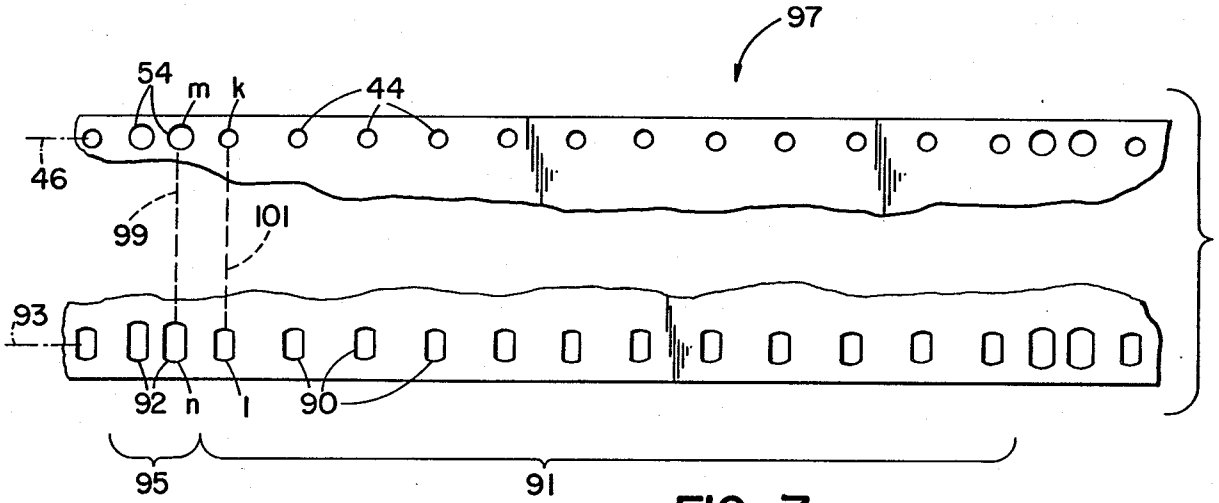
FIG. 7 is a reduced scale plan view of a portion of another web embodying the invention.

FIG. 7 illustrates another web 97 embodying the invention, which web is adapted to fit over the sprockets 14 and 16 despite the fact that the sprockets are fixed to the shaft and the width of the web 97 may differ from that of the web 12 due to variations in temperature and humidity or manufacture tolerance. The web 97 is identical to the web 12 except that the web 97 includes row segments 91,91 of laterally elongated driving holes 90,90 instead of row segments 45,45 of the round driving holes 48,48, and laterally elongated keying holes 92,92 instead of the round keying holes 56,56, the lateral elongation of the driving and keying holes compensates for the variation in web width by accommodating the driving and keying pins of the sprocket 16 despite such variations.

The keying holes 92,92 are located in keying zones 95,95 between the row segments, and the driving holes 90,90 and the keying holes 92,92 are located along a line 93 parallel to the side edges of the web 97. Each driving hole 90 laterally aligns with and corresponds to a driving hole 44 as indicated by a line 101 which is perpendicular to the side edges of the web and the line 93 and passes through the driving hole 44 indicated as k and the driving hole 90 indicated as 1. Each keying hole 92 laterally aligns with and corresponds to one of the keying holes 54 as indicated by a line 99 which is perpendicular to the side edges of the web 97 and passes through the keying hole 54 indicated as m and the keying hole 92 indicated as n. The keying holes 92,92 are wide enough in the longitudinal direction to fit over the keying pins 36,36, and the driving holes 90,90 are wide enough in the longitudinal direction to fit over the driving pins 32,32 but not over the keying pins 92,92. Also, the keying holes 92,92 are somewhat longer in the transverse direction than the driving holes 90,90 because the keying pins are broader than the driving pins. Also, because the keying holes 92,92 of each keying zone are longer, wider, and spaced closer to each other than are the driving holes 90,90, the keying holes stand out, and because the keying holes 92,92 within each keying zone 93 laterally align with the corresponding keying holes 54,54, the keying holes 92,92 and 54,54 together with the keying pins 34,34 and 36,36 identify the proper loading orientation of the web 97.

In the embodiments of FIGS. 2 to 6 and 7, each keying zone of the involved web is shown to be of a length longitudinally of the web equal to twice the uniform spacing between the driving holes of each row segment. In accordance with other embodiments of the invention, the length of the keying zones is different from this to lend additional distinctiveness to the keying zones, thereby allowing them to be still more readily distinguished from the driving holes. That is, in such embodiments of the invention, the length of each keying zone is greater than two times and less than three times the length of the uniform spacing between the driving holes of each row segment. The appearance of each keying zone thus represents an interruption in the regular spacing used by the driving holes, and this makes each keying zone more discernible to an operator when loading a web onto the sprockets. The pins of the associated sprockets are complementarily arranged to suit the arrangement of the driving and keying holes on the web.

Figure 8:
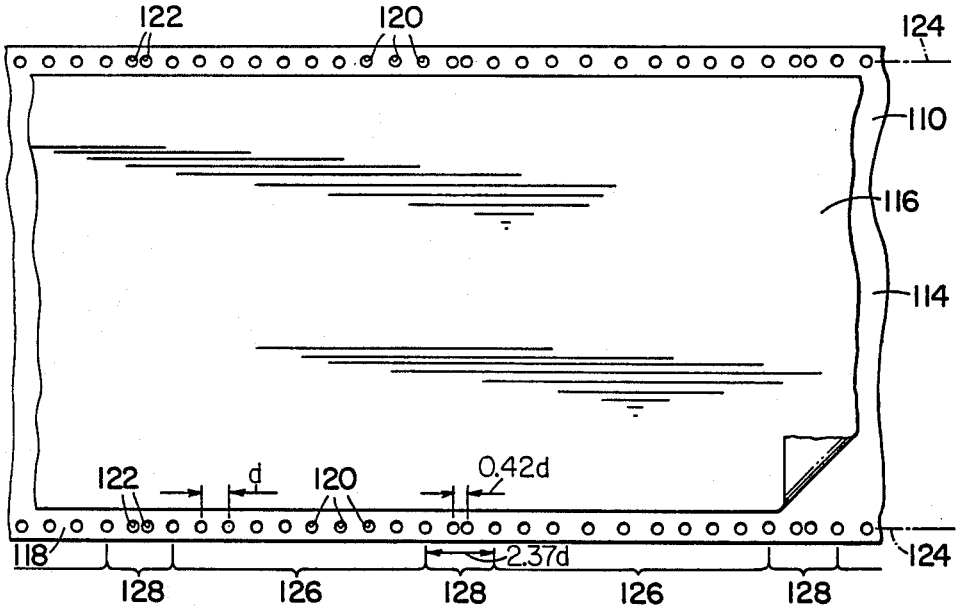
FIG. 8 is a fragmentary plan view of a portion of web according to another embodiment of the invention.
Figure 9:
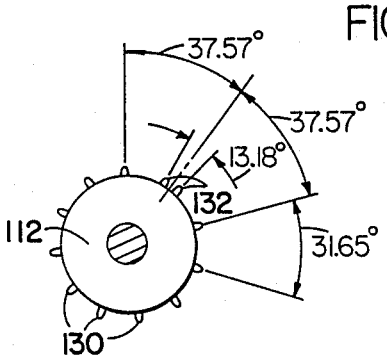
FIG. 9 is a side view of a sprocket for use with the web of FIG. 8.

FIGS. 8 and 9 show parts of an exemplary web loading and feeding system of the immediately foregoing character. FIG. 8 shows the web 110 of the system and FIG. 9 shows one sprocket 112, two of which are used in place of the sprockets 14 and 16 of the machine 10 of FIG. 1 to feed the web 110.

The web 110 is comprised of a base layer or sheet 114 consisting, for example, of relatively heavy paper stock, and an upper layer 116 of vinyl or other sign making sheet material releasably adhesively secured to the base layer 114.

For feeding the web 110 the base layer 114, along each of its marginal edge portions 118,118, has a number of driving holes 120,120 and keying holes 122 located on a common longitudinal line 124. The driving holes 120,120 are uniformly spaced from one another by a spacing d and are arranged in row segments 126,126 spaced from one another by keying zones 128,128. Each row segment 126 contains ten driving holes 120,120 and each keying zone contains two keying holes 122,122. Each keying zone 128 has a length greater than two times and less than three times the uniform spacing d between the driving holes 120,120, and the two keying holes 122,122 of each keying zone are located on opposite sides of the longitudinal center of each keying zone and are spaced closer to one another than the spacing d between the driving holes 120,120.

Preferably, and as shown in FIG. 8, the two keying holes 122,122 of each keying zone are located symmetrically within the keying zone so as to be spaced equal distances but in opposite directions from the longitudinal center of the keying zone. The actual length of each keying zone and the spacing of the two keying holes of each zone from one another may vary while keeping within the general prescription that the keying zones have a length greater than two times and less than three times the spacing d and that the keying holes be spaced from one another by a spacing less than the distance d. However, by way of example, in FIG. 8 each keying zone 128 has been shown to have a length equal to approximately 2.37d and the keying holes of each keying zone have been shown to be spaced from one another by a spacing of approximately 0.42d.

It will also be noted in the web 110 of FIG. 8 that the sheet 116 of sign making material is of lesser width than the base sheet 114 with the longitudinal edges of the sheet 116 being spaced inwardly of the driving and keying holes in the two longitudinal edge portions of the web. This construction results in a saving of sign making material in comparison, for example, to the web 12 of FIGS. 1 to 6 wherein the sheet of sign making material is of a width equal to that of the sheet of base material. However, the width of the sign making material 116 is not of prime importance to the invention and, if desired, in the embodiment of FIG. 8 the sheet of sign making material 116 may be made of equal width to the base sheet 114 so that the driving and keying holes pass through it as well as through the sheet of base material.

The sprocket 112 shown in FIG. 9 cooperates with the web 110 of FIG. 8 with, as mentioned, the machine 10 of FIG. 1 being equipped with two such sprockets in place of the sprockets 14 and 16 so that one sprocket 112 engages each of the rows of holes in the longitudinal marginal portions 118,118 of the web 110. The sprocket 112 has ten driving pins 130,130 for cooperation with the driving holes 120,120 of the web and two keying holes 132,132 for cooperation with the keying holes 122,122 of the web. The angular spacing between the various pins is such as to match the spacing of the driving holes 120,120 and keying holes 122,122 of the web. In particular, for the specific hole spacing indicated in FIG. 8 the driving pins 130,130 of the sprocket 112 are spaced uniformly from one another by a spacing of 31.65°; the keying pins 132 are located within an angular arc of 75.14° and within that arc the two keying pins 132 are spaced from one another by an angular distance of 13.18° and are equally spaced on opposite sides from the center point of the 75.14° arc.

Referring again to FIG. 8, it will be noted that the keying holes 122,122 are of the same size and shape as the driving holes 120,120. Nevertheless, the keying holes 122,122 are readily visibly discernible from the driving holes 120 by virtue of the fact that each keying zone 128 in which the keying holes are located is an interruption in the regular spacing of the driving holes 120,120; and the closer spacing of the two keying holes 122,122 in each zone is another interruption in the uniform spacing of the driving holes. Therefore, when placing the web 110 on the two related sprockets 112,112 of the sign making machine, the operator is able to readily identify the keying holes 122,122 and to place them properly on the keying pins 132,132 of the two sprockets to assure proper loading of the web.

Figure 10:
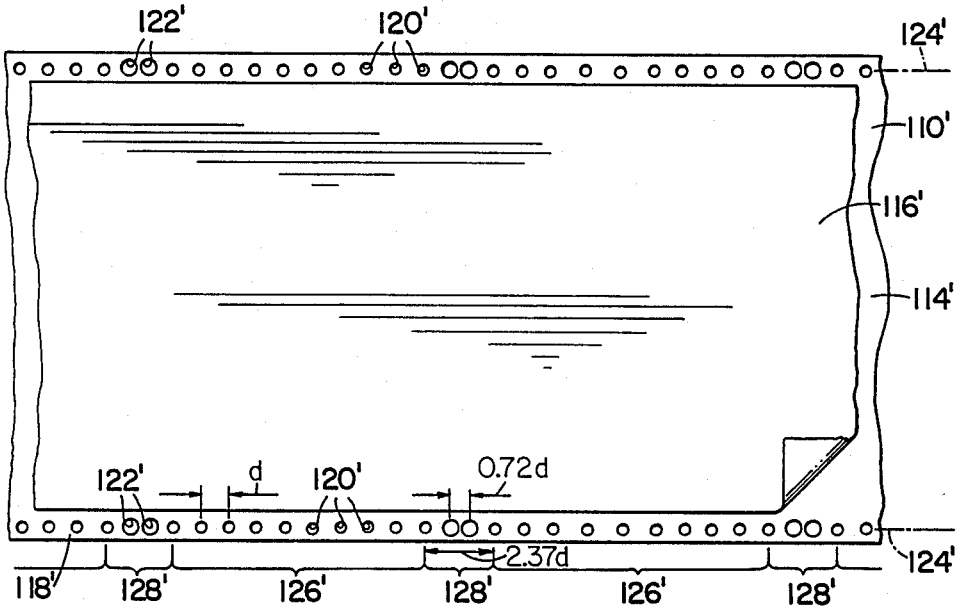
FIG. 10 is a fragmentary plan view of a portion of web according to still another embodiment of the invention.
Figure 11:
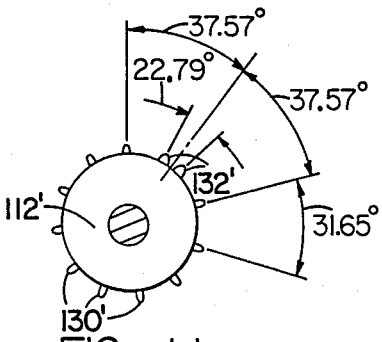
FIG. 11 is a side view of a sprocket for use with the web of FIG. 10.

In the embodiment of FIGS. 8 and 9 the keying holes 122,122 of the web are of the same size and shape as the driving holes 120,120. However, if desired, the keying holes 122 may be made of a different shape and/or of a different size than the driving holes 120,120 to still further distinguish the keying holes from the driving holes. FIGS. 10 and 11, for example, show parts of a web loading and feeding system wherein the keying holes of the web are circular, as are the driving holes, but are of larger diameter than the driving holes. Except for the larger size and spacing of the keying holes, the web of FIG. 10 is similar to that of the web of FIG. 8 and the sprocket of FIG. 11 is generally similar to that of FIG. 9 so that similar reference numerals have been applied in FIGS. 10 and 11 as in FIGS. 8 and 9 except for being primed. Because of the larger diameter of the keying holes 122',122', the two keying holes in each keying zone are spaced slightly further from one another than are the keying holes 122,122 of FIG. 8. For example, in FIG. 10 the two keying holes 122',122', of each keying zone are spaced from one another by a spacing of 0.72d. In the sprocket 112' of FIG. 11 the two keying pins 132',132', are of a size complementary to the keying holes 122',122', and are spaced from one another by a distance matching the spacing of the keying holes 122',122', from one another in the web.

In the webs of FIGS. 8 and 10 the holes in one side edge portion of each web have been shown to be of the same shape as those in the other side edge portion. It will be understood, however, that if desired the holes in one side edge portion may be laterally elongated in comparison to those of the other side edge portion in accordance with the general principle shown by and discussed in connection with FIG. 7.

By the foregoing, web loading and feeding systems have been disclosed embodying the present invention. However, numerous modifications and substitutions may be made without deviating from the spirit of the invention. For example, the keying pins and the driving pins on each sprocket may be made of different colors to further visually identify corresponding, aligned portions of the sprockets. In addition, the driving and keying holes of the web may be made of various shapes different from those shown with the driving and keying pins of the sprockets being of complementary shapes. Further, the keying holes of a web may be of different shape than the driving holes to still more visibly differentiate the keying zones from the remainder of the rows of holes extending along the edges of the web.

It is also possible to provide a web loading and feeding system similar to those illustrated and described in which the pins on one sprocket are angularly advanced relative to the corresponding pins on the other sprocket, and the holes in the corresponding side edge portion of the web are similarly, longitudinally advanced relative to the holes in the other side edge portion.

Therefore, the invention has been described by way of example and not by limitation.

We claim:

1. A web for use with a web handling machine having a pair of web feeding sprockets, each sprocket having a circumference with a first portion which contains only a plurality of driving pins spaced uniformly along said first portion of said circumference and a second portion which contains only two keying pins spaced along said second portion, said web comprising:

an elongated sheet-like member having parallel side edges and a plurality of driving holes and keying holes in each side edge portion for cooperation with said driving pins and said keying pins of a respective one of said sprockets to feed said web longitudinally of itself, said driving holes and said keying holes in each side edge portion being longitudinally aligned with one another, and said driving holes in each side edge portion being arranged in row segments, each row segment being separated from a next row segment by a keying zone including no holes except for two of said keying holes, said driving holes of said row segments being spaced from one another at regular intervals along the length of each of said row segments, each of said keying zones having a length greater than two times and less than three times the length of one of said regular intervals, and said two keying holes of each keying zone being located on opposite sides of the longitudinal center of said zone, so that each keying zone represents a readily visibly discernible interruption in the regular spacing of said driving holes insofar as each keying zone has a length not an integral multiple of the length of one of said intervals and insofar as the two keying holes of each keying zone are more closely spaced to one another than are said driving holes to one another.

2. A web as set forth in claim 1 wherein said driving holes and said keying holes in one side edge portion of the web are substantially laterally aligned with said driving holes and said keying holes, respectively, in the other side edge portion of the web.

3. A web as set forth in claim 1 wherein said keying holes are of a size different from that of said driving holes.

4. A web as set forth in claim 3 wherein said keying holes are larger than said driving holes.

5. A web as set forth in claim 1 wherein said keying holes and said driving holes in one side edge portion of the web are laterally elongated in comparison to those of the other side edge portion of the web.

6. A web as set forth in claim 1 wherein said driving holes are all of the same size and said keying holes are of a size different from said driving holes.

7. A web loading and feeding system comprising:

a pair of sprockets, each sprocket having a first circumferential zone including a plurality of driving pins spaced uniformly along said first zone and having a second circumferential zone with a length greater than two times and less than three times the spacing between adjacent ones of said driving pins, said sprockets being mounted for rotation about a common axis, and a web comprising an elongated sheet-like member having parallel side edges and a plurality of driving holes and keying holes in each side edge portion, said driving pins and said keying pins of each sprocket cooperating with said driving holes and said keying holes, respectively, in each side edge portion of said web to feed said web longitudinally of itself, said driving holes and said keying holes in each side edge portion being substantially longitudinally aligned with one another and said driving holes in each side edge portion being arranged in row segments, each row segment being separated from a next row segment by a keying zone having no holes except for two keying holes, said driving holes of each of said row segments being spaced from one another at regular intervals along the length of each of said row segments and each of said keying zones having a length greater than two times and less than three times the length of one of said regular intervals, said two keying holes of each keying zone being located on opposite sides of the longitudinal center of said keying zone that each keying zone represents a readily visibly discernible interruption in the regular spacing of said driving holes insofar as each keying zone has a length not an integral multiple of the length of one of said interals and insofar as the two keying holes of each keying zone are more closely spaced to one another than are said driving holes to one another.

8. A web loading and feeding system as set forth in claim 7 wherein said keying pins are larger than said driving pins and said keying holes are larger than said driving holes.

9. A web loading and feeding system as set forth in claim 7 said keying pins are of a size different from that of said driving pins and said keying holes are of a size different from that of said driving holes.

10. A web loading and feeding system as set forth in claim 7 wherein said driving holes and said keying holes in one side edge portion of the web are substantially laterally aligned with said driving holes and said keying holes, respectively, in the other side edge portion of the web.

* * * * *